US006145319A

United States Patent [19]

Burns et al.

[11] Patent Number: 6,145,319

[45] Date of Patent: Nov. 14, 2000

[54] TRANSITIONAL MULTIHOLE COMBUSTION LINER

[75] Inventors: Craig P. Burns, Mason; Beverly S. Duncan, West Chester; James E. Thompson, Middletown; Glenn E. Wiehe, Mt. Healthy, all of Ohio

[73] Assignee: General Electric Company, Cincinnati, Ohio

[21] Appl. No.: 09/116,509

[22] Filed: Jul. 16, 1998

[51] Int. Cl.[7] ..... F02C 1/00

[52] U.S. Cl. ..... 60/755; 60/754

[58] Field of Search ..... 60/762, 754, 755

[56] References Cited

U.S. PATENT DOCUMENTS

| | | | |
|---|---|---|---|
| 5,181,379 | 1/1993 | Wakeman et al. | 60/261 |
| 5,233,828 | 8/1993 | Napoli | 60/261 |
| 5,241,827 | 9/1993 | Lampes | 60/754 |
| 5,261,223 | 11/1993 | Foltz | 60/39.36 |
| 5,279,127 | 1/1994 | Napoli | 60/754 |
| 5,775,108 | 7/1998 | Ansart et al. | 60/752 |
| 5,778,676 | 7/1998 | Joshi et al. | 60/755 X |
| 6,029,455 | 2/2000 | Sandelis | 60/752 |

FOREIGN PATENT DOCUMENTS 6218569 2/1987 Japan .

OTHER PUBLICATIONS

Northern Research and Engineering Corporation, "The Design and Development of Gas Turbine Combustors," NREC Report No. 1344–1, 1980, pp: Cover, iii, 3.1–5, 3.28–36, 3.40, 3.65, 3.80, 3.86, 3.87, and 3.89.

*Primary Examiner*—Timothy S. Thorpe
*Assistant Examiner*—David J. Torrente
*Attorney, Agent, or Firm*—Andrew C. Hess; Rodney M. Young

[57] ABSTRACT

A combustor liner includes a wall having an outboard surface and an opposite inboard surface. A plurality of first holes are inclined through the wall in a multihole pattern to channel cooling fluid therethrough to form a cooling film layer along the inboard surface. A second hole extends perpendicularly through the wall within the multihole pattern to form a shadow along the inboard surface devoid of the first holes. A transition hole extends through the wall in the shadow at a greater inclination than the first holes for cooling the wall at the shadow.

20 Claims, 4 Drawing Sheets

TRANSITIONAL MULTIHOLE COMBUSTION LINER

BACKGROUND OF THE INVENTION

The present invention relates generally to gas turbine engines, and, more specifically to combustors therein. In a gas turbine engine, air is pressurized in a compressor and channeled to a combustor, mixed with fuel, and ignited for generating hot combustion gases which flow downstream through one or more turbine stages. In a turbofan engine, a high pressure turbine drives the compressor, and is followed in turn by a low pressure turbine which drives a fan disposed upstream of the compressor.

A typical combustor is annular and axisymmetrical about the longitudinal axial centerline axis of the engine, and includes a radially outer combustion liner and radially inner combustion liner joined at upstream ends thereof to a combustor dome. Mounted in the dome are a plurality of circumferentially spaced apart carburetors each including an air swirler and a center fuel injector. Fuel is mixed with the compressed air from the compressor and ignited for generating the hot combustion gases which flow downstream through the combustor and in turn through the high and low pressure turbines which extract energy therefrom.

A major portion of the compressor air is mixed with the fuel in the combustor for generating the combustion gases. Another portion of the compressor air is channeled externally or outboard of the combustor for use in cooling the combustion liners. Another portion of the compressor air is channeled radially through the combustion liner as a jet of dilution air which both reduces the temperature of the combustion gases exiting the combustor and controls the circumferential and radial temperature profiles thereof for optimum performance of the turbines.

A combustor is typically cooled by establishing a cooling film of the compressor air in a substantially continuous boundary layer or air blanket along the inner or inboard surfaces of the combustion liners which confine the combustion gases therein. The film cooling layer provides an effective barrier between the metallic combustion liners and the hot combustion gases for protecting the liners against the heat thereof and ensuring a suitable useful life thereof.

In a typical combustor, the film cooling layer is formed in a plurality of axially spaced apart film cooling nuggets which are annular manifolds fed by a plurality of inlet holes, with a downstream extending annular lip which defines a continuous circumferential outlet slot for discharging the cooling air as a film along the hot side of the liners. The rows of nuggets ensure that the film is axially reenergized from row to row for maintaining a suitably thick boundary layer to protect the liners.

In a recent development in combustor design, a multihole film cooled combustor liner eliminates the conventional nuggets and instead uses a substantially uniform thickness, single sheet metal liner with a dense pattern of multiholes to effect film cooling. The individual multiholes are inclined through the liner at a preferred angle of about 20°, with an inlet on the outboard, cold surface of the liner, and an outlet on the inboard, hot surface of the liner spaced axially downstream from the inlet. The diameter of the multiholes is about 20–30 mils (0.51–0.76 mm). This effects a substantially large length to diameter ratio for the multiholes for providing internal convection cooling of the liner therearound. And, most significantly, the small inclination angle allows the discharged cooling air to attach along the inboard surface of the liner to establish the cooling film layer which is fed by the multiple rows of the multiholes to achieve a maximum boundary layer thickness which is reenergized and maintained from row to row in the aft or downstream direction along the combustor liners.

An example of the multihole combustor liner is found in U.S. Pat. No. 5,181,379 assigned to the present assignee, and several additional patents therefor have also issued thereafter. For example, in U.S. Pat. No. 5,261,223, also assigned to the present assignee, an improved multihole combustor liner is disclosed which includes rectangular film restarting holes disposed downstream of the dilution holes. Since the purpose of the dilution holes is to inject substantially large volumes of the compressor air in jets radially into the combustor for controlling the exit gas temperature profiles, the dilution holes inherently interrupt the film cooling layer locally downstream therefrom. Relatively large rectangular film restarting holes are introduced in the combustor liner downstream of the dilution holes and upstream of corresponding ones of the multiholes. The restarting holes are inclined at the same angle, for example 20°, as the multiholes for reintroducing the cooling air in attachment along the hot side of the liner.

However, in view of the 20° inclination angle of the multiholes, or the rectangular restarting holes, there remains downstream of the individual dilution holes a dry or shadow region on the hot side of the liner which is inherently devoid of film cooling injection sites. Since the multiholes are inclined downwardly in a downstream direction from the dilution holes, their inlets may be spaced closely adjacent to the downstream portions of the dilution holes, but their outlets are necessarily spaced further downstream from the dilution holes forming the imperforate shadow on the inboard side of the liner downstream of the dilution holes. The multiholes are not allowed to intersect each other or the dilution holes to avoid undesirable stress concentration thereat. The multiholes are typically arranged in uniform patterns, or sub-patterns, for both maximizing the effectiveness of the established cooling film layer as well as ensuring mechanical strength of the liner for obtaining a suitable useful life.

The multihole shadows are acceptable for relatively small secondary holes through the liner such as secondary dilution holes. As the diameter of such secondary holes increases, the corresponding shadow necessarily increases in area, with an attendant higher liner operating temperature which can adversely affect combustor life.

For example, in a further development of multihole combustors for higher thrust engines, the heat loads in the combustor correspondingly increase, which in turn increases the operating temperature in the multihole shadows. The increased temperature decreases the life of the liner which would eventually fail by thermal fatigue cracks in the shadows adjacent to secondary holes.

Accordingly, it is desired to further improve the multihole combustor liner with improved cooling around the secondary holes.

SUMMARY OF THE INVENTION

A combustor liner includes a wall having an outboard surface and an opposite inboard surface. A plurality of first holes are inclined through the wall in a multihole pattern to channel cooling fluid therethrough to form a cooling film layer along the inboard surface. A second hole extends perpendicularly through the wall within the multihole pattern to form a shadow along the inboard surface devoid of the first holes. A transition hole extends through the wall in the shadow at a greater inclination than the first holes for cooling the wall at the shadow.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENTS

Figure 1:
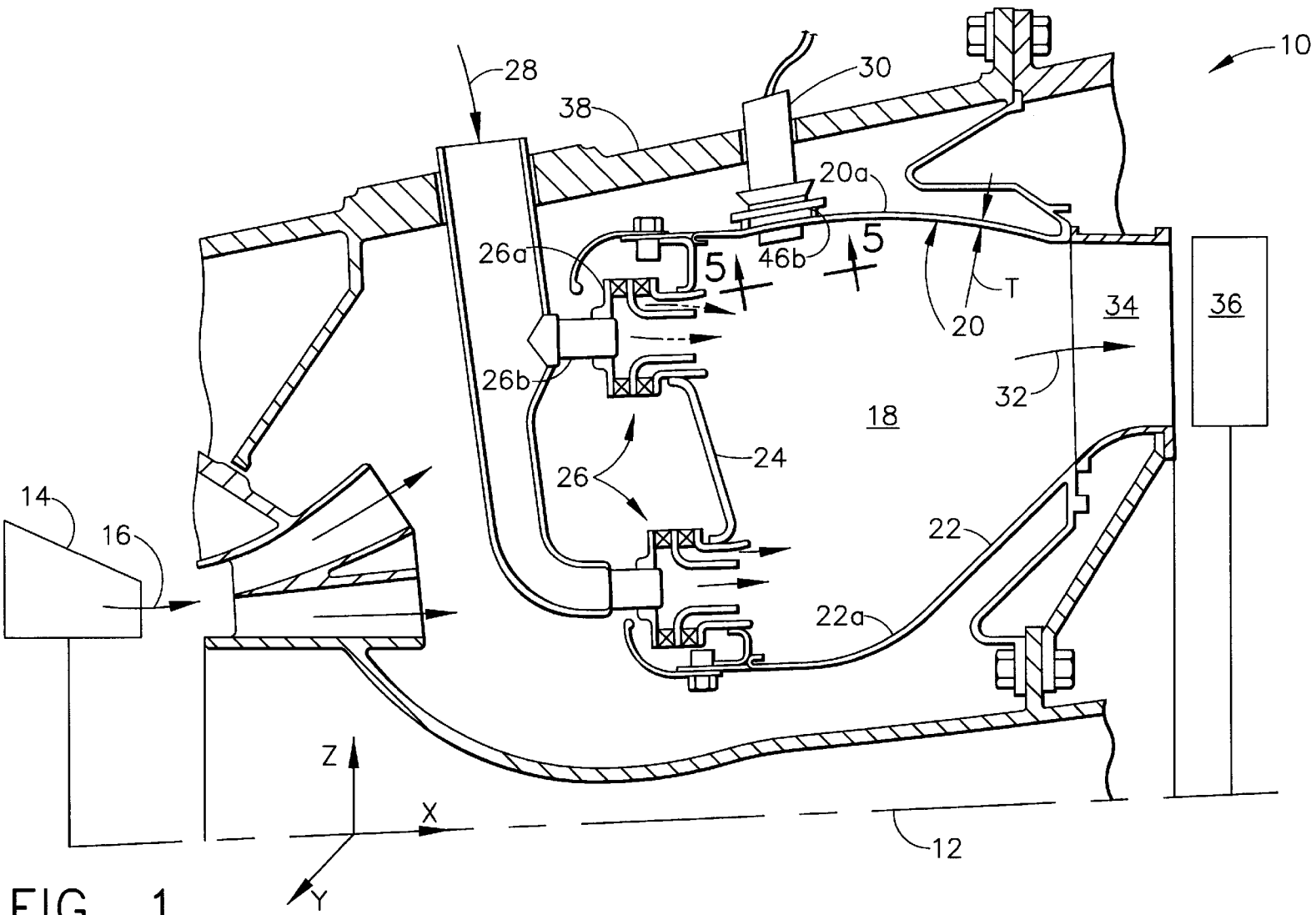
FIG. 1 is an axial sectional view of an axisymmetrical annular combustor having multihole cooling in accordance with an exemplary embodiment of the present invention.

Illustrated schematically in FIG. 1 is a portion of a turbofan gas turbine engine 10 which is axisymmetrical about a longitudinal or axial centerline axis 12. The engine includes a multi-stage axial compressor 14 for pressurizing air 16 channeled to an annular combustor 18. The combustor 18 includes a radially outer liner 20 and a radially inner liner 22 spaced inwardly therefrom, and having axially forward or upstream ends joined to an annular dome 24.

The combustor 18 is in the exemplary form of a double-dome combustor having two concentric rows of carburetors 26 which mix a portion of the pressurized compressor air 16 with fuel 28 for forming a combustible fuel and air mixture ignited by an igniter 30 for generating hot combustion gases 32 which are discharged from an outlet defined at axially aft or downstream ends of the liners 20, 22. A high pressure turbine nozzle 34 includes a plurality of circumferentially spaced apart vanes adjoining the combustor outlet for guiding the combustion gases 32 through a row of high pressure turbine rotor blades 36 which are operatively joined to the compressor 14 for powering thereof.

The combustor 18 is coaxially mounted inside an annular casing 38 and is surrounded by the pressurized air 16 received from the compressor 14. The carburetors 26 may take any conventional form including a counter-rotation swirler 26*a* which receives a portion of the compressor air 16 for mixing with the fuel 28 discharged from a central fuel injector 26*b*.

But for the combustor 18, the engine 10 may take any conventional form. The combustor liners 20, 22 are each formed of a suitable metal and are arcuate or annular about the centerline axis 12. Each liner is in the form of a single sheet metal plate or wall 20*a*, 22*a*, respectively, of a substantially uniform thickness T.

Figure 2:
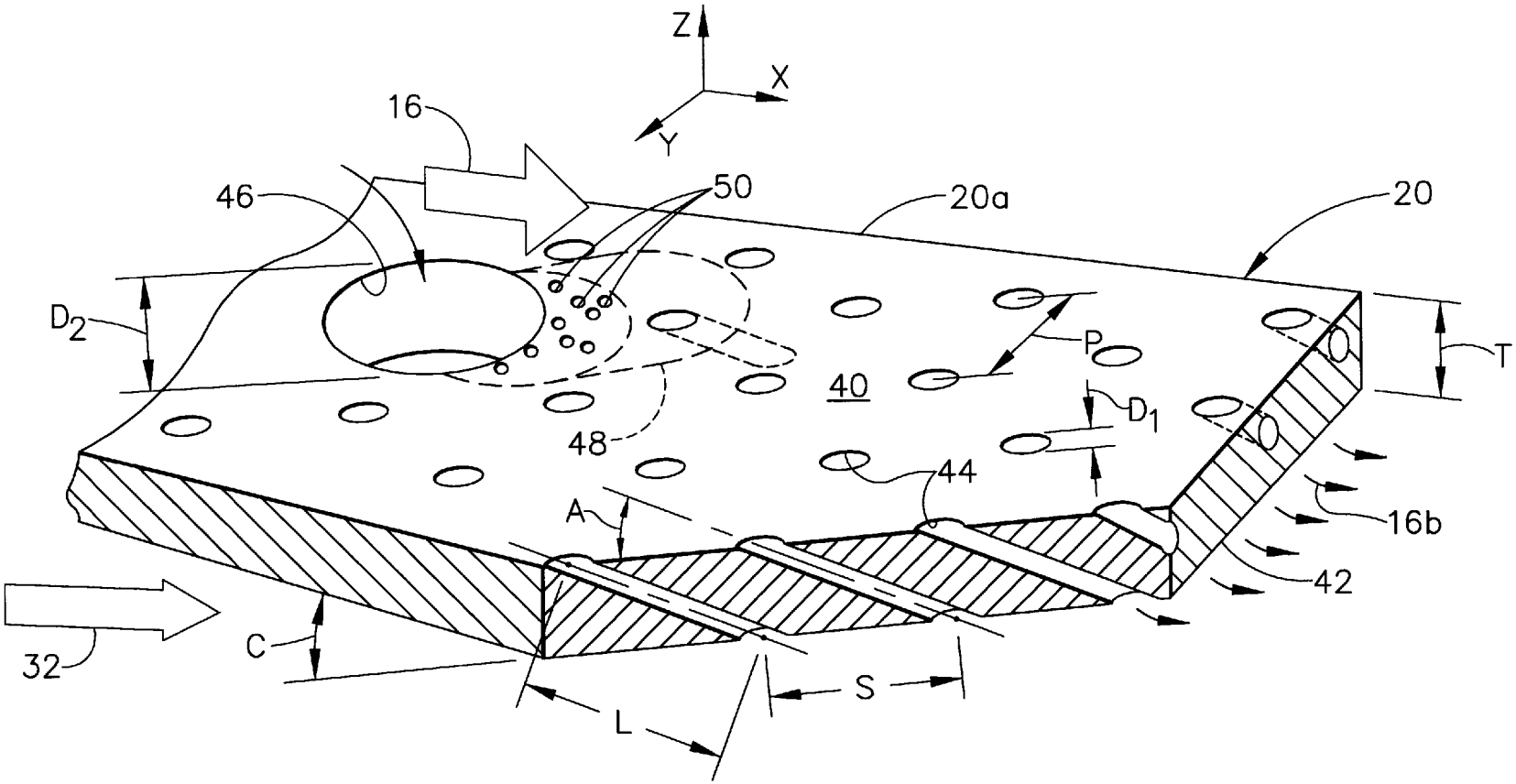
FIG. 2 is an isometric, partly section view of a portion of an outer liner of the combustor illustrated in FIG. 1 including a pattern of multiholes disposed downstream from a larger secondary hole, with transition holes disposed therebetween in accordance with an exemplary embodiment of the present invention.

A portion of the outer liner wall 20*a* is illustrated in more detail in FIG. 2. The outer liner includes an outboard or first surface 40 over which is flowable a portion of the compressor air 16. An opposite, inboard or second surface 42 faces the hot combustion gases 32 on the inside of the combustor and therefore requires suitable cooling.

A plurality of first holes 44 are inclined through the outer liner in a predetermined multihole pattern to channel a portion of the compressor air 16 therethrough as a cooling fluid to form a cooling film layer 16*b* of the cooling fluid along the inboard surface 42 to both cool the outer liner and reduce the heat load thereto from the combustion gases 32. The inner liner 22 illustrated in FIG. 1 also includes the multiholes 44 for the cooling thereof.

In multihole film cooling, the multiholes 44 themselves are suitably inclined in a downstream direction and closely spaced together both axially and circumferentially for providing a dense pattern of holes for maintaining an effective cooling film layer 16*b* along the inboard surfaces of the liners. The multihole pattern may be defined by certain geometric parameters illustrated in more particularity in FIGS. 2 and 3. Each multihole 44 is typically cylindrical with a small diameter $D_1$ which may be about 20 mils (0.51 mm) for example.

Each multihole 44 has a longitudinal centerline axis inclined at an acute inclination angle A which is about 15°–20°, and preferably 20° for maintaining attached air delivery to the film layer 16*b*. The multiholes have a pitch spacing S in the axial direction designated X, which axial pitch is about six and a half times the hole diameter, or about 130 mils (3.3 mm) for example. The multiholes also have a lateral or circumferential pitch P in the circumferential or tangential direction designated Y which is about seven times the hole diameter, or about 140 mils (3.56 mm) for example. The radial direction is designated Z.

The multiholes are also typically arranged in a series of axially spaced apart rows, with each row typically being circumferentially offset to adjacent axial rows for maximizing multihole density and producing an axially and circumferentially uniform film layer 16*b*.

Since the multiholes 44 are inclined at the shallow inclination angle A of about 20°, they have a corresponding length L of about 234 mils (5.9 mm) for a liner thickness T of about 80 mils (2 mm), with a corresponding length over diameter aspect ratio $L/D_1$ of about 11.7. Each multihole 44 has an inlet on the cold surface 40 and an outlet on the hot surface 42 disposed axially aft or downstream from the inlet so that the cooling air 16 flows axially aft through the multiholes 44 and radially inwardly for discharge at a large obtuse angle along the inboard surface 42 for feeding the film layer 16*b* and maximizing film cooling effectiveness.

Figure 3:
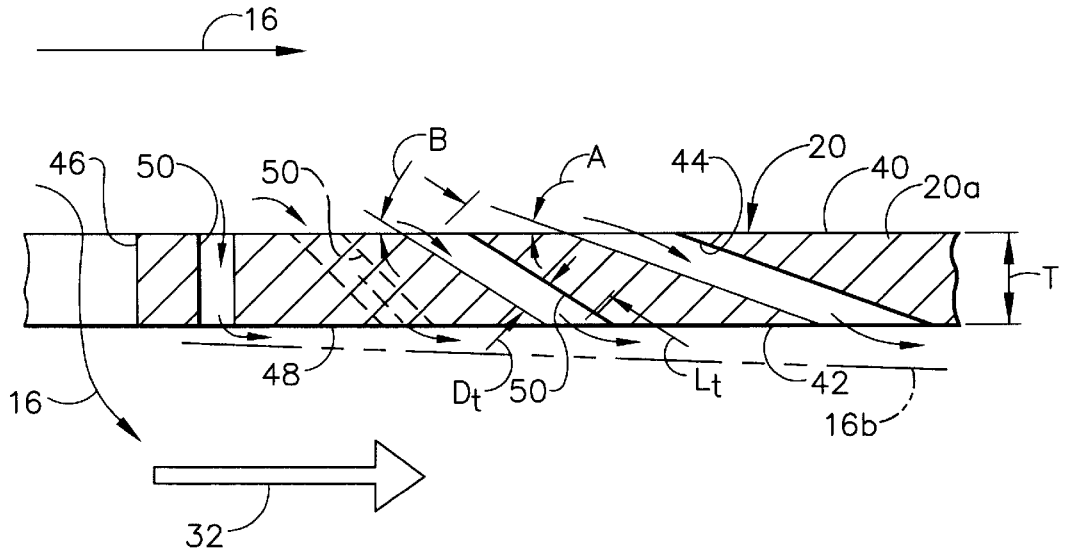
FIG. 3 is a radial sectional view through a portion of the liner illustrated in FIG. 2 and taken along line 3—3.

As illustrated for example in FIGS. 2 and 3, the outer liner 20 typically includes one or more large secondary or second holes 46 extending perpendicularly through the wall 20*a* within the multihole pattern which form downstream regions or shadows 48 along the inboard surface. The shadows are without or devoid of the multiholes 44 in which the film layer 16*b* is locally interrupted or disrupted. Examples of the shadow 44 are most clearly shown in FIG. 4 which illustrates the inboard surface 42 and the respective outlets of the multiholes 44 and second holes 46. Examples of such secondary holes include the dilution hole 46 illustrated in FIGS. 2–4; an igniter hole 46*b* illustrated in FIGS. 1 and 5; and a borescope hole 46*c* also illustrated in FIG. 4.

Figure 4:
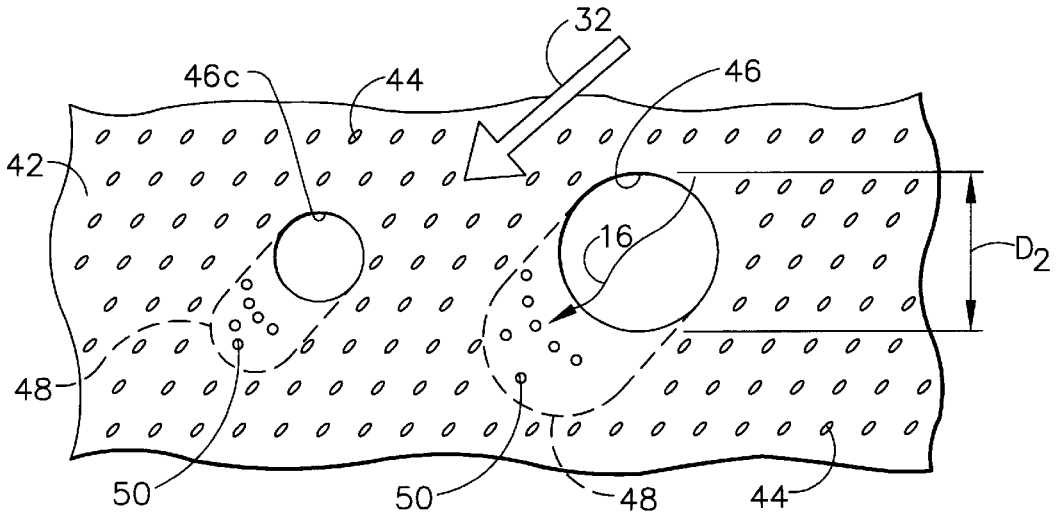
FIG. 4 is an outwardly facing view of a portion of the outer liner illustrated in FIG. 1 taken from inside the combustor to show multihole shadows between the multiholes and corresponding ones of secondary holes, with the transition holes disposed therebetween in an exemplary embodiment.

These exemplary secondary holes 46, 46*b*, 46*c* are always larger in diameter $D_2$ than the diameter $D_1$ of the multiholes 44, and the shadows 48 as shown in FIG. 4 extend both laterally or circumferentially across the diameter of the secondary hole 46 as well as axially between the secondary holes 46 and downstream ones of the multiholes 44 due to the predominant swirl of the combustion gases.

A major reason for the creation of the shadow 48 is the structural limitation of preventing multiholes 44 from intersecting any other holes, including the secondary holes 46, which would create undesirable stress concentrations thereat. As shown in FIG. 2, the inlet ends of the multiholes 44 may only be positioned so close to the downstream edge of the secondary hole 46 in order to avoid local stress concentration therebetween. The combustion liners are subject during operation to both pressure loads and thermal loads which generate stress in the single liners thereof. Any hole placed through a load carrying member, such as the outer liner 20, necessarily distorts the load carrying path therethrough and affects the local stress therearound. Since the inlets ends of the multiholes 44 must be suitably spaced from the downstream edges of the secondary hole 46, the outlets of the multiholes 44 are correspondingly spaced even further downstream from the downstream edges of the secondary holes 46 creating a substantially larger shadow 48 along the inboard surface 42.

As indicated above, the relatively large secondary holes 46 interrupt the uniform multihole pattern and necessarily eliminate the film layer directly below the secondary holes 46, as well as locally interrupt the film layer downstream therefrom in the shadow 48 until the next multiholes 44 are found for again re-establishing and feeding the boundary layer 16*b* with the cooling air 16.

In accordance with the present invention, one or more transition or third holes 50 extend through the outer liner 20 in the shadow 48 at a greater inclination angle B, see FIG. 3, than the inclination angle A of the multiholes 44 which allows the transition holes to physically fit in the shadow 48 for cooling the wall thereat. Although the multiholes 44 are inclined at the shallow acute angle A which is limited to about 20° for optimum performance of the cooling film layer 16*b*, this physically prevents additional ones of the multiholes 44 from being used in the shadow 48 since they would either intersect adjacent holes or be close thereto, both of which alternatives are unacceptable for maintaining adequate strength and liner life. However, by introducing the transition holes 50 at a greater inclination angle cooling therefrom may nevertheless be effected while still maintaining adequate strength of the liner. The shadow 48 preferably includes a plurality of the transition holes 50 spaced apart from each other to cool the liner wall 20*a* at the shadow 48. FIG. 3 illustrates three exemplary forms of the transition holes 50 which vary in their respective inclination angles B.

In particular, the transition holes 50 decrease in inclination angle B downstream or aft from the secondary hole 46 toward the restart of the multiholes 44 at the aft end of the shadow 48. In this way, the transition holes 50 may optimally be positioned through the liner wall 20*a* in the shadow 48 for maximizing available cooling therefrom while minimizing disruption in the loadpaths through the liner and attendant stress concentrations therefrom.

Since the shadow 48 extends axially downstream from the secondary hole 46, the liner wall 20*a* in this region preferably includes a plurality of axially spaced rows of the transition holes 50, as shown in FIGS. 2 and 3 for example, which are spaced apart between the secondary hole 46 and the multiholes 44. Note from FIGS. 2 and 4 that the shadows 48 extend both in the axially downstream direction as well as circumferentially due to the inherent circumferential swirl of the combustion gases 32 inside the combustor 18. The multiholes 44 are preferably inclined to correspond with the prevailing swirl of combustion gases 32 generally coextensively with the orientation of the shadow 48.

All of the multiholes 44 typically have the same diameter $D_1$, and, similarly, all of the transition holes 50 typically have the same diameter $D_t$, which is also preferably equal to the diameter of the multiholes 40. The many multiholes 44 and transition holes 50 may therefore be conventionally formed using laser drilling, for example, to provide equal diameter holes for promoting cooling of the liner, with the different inclination angles as desired. The secondary hole 46 is substantially larger in diameter than the multiholes 44 and the transition holes 50. For example, a dilution hole 46 may vary in diameter from about 300 mils (7.6 mm) to about 500 mils (12.7 mm) as required for promoting the desired temperature profile factors at the combustor outlet.

As indicated above, the multiholes 44 have a length-to-diameter aspect ratio $L/D_1$ of about 11.7 for example which is substantially greater than 1.0. The secondary hole 46 has a length expressed by the thickness T of the liner over diameter aspect ratio $T/D_2$ which varies from 0.27 to 0.16 for the exemplary dilution hole size range, and which are substantially less than 1.0.

The hole aspect ratio is significant since internal convection cooling around the hole increases with increasing aspect ratio. The shallow multiholes 40 are relatively long with enhanced internal convection cooling thereof, whereas the secondary hole 46 is relatively short without significant internal convection cooling. The transition holes 50 preferably have a length $L_t$ over diameter $D_t$ aspect ratio correspondingly between the aspect ratios of the multiholes 44 and the secondary holes 46. In this way, the transition holes 50 at least provide internal convection cooling of the liner in the region of the shadow 48 while maintaining suitable separation between adjacent holes. And, the inclination angle B of the transition holes 50 may vary between the secondary holes 46 and the multiholes 44 to additionally restart the cooling film layer 16*b* interrupted by the secondary hole 46.

In the exemplary embodiment illustrated in the FIGS. 2 and 3, the transition holes 50 in the forward row immediately adjacent the secondary hole 46 extend substantially perpendicularly through the liner wall 20*a* with a corresponding inclination angle B of 90°. In this way, the perpendicular transition hole 50 may be positioned closely adjacent to the secondary hole 46 along its downstream edge to provide at least internal convection cooling in the liner and discharging the cooling air 16 for initially reestablishing the cooling film layer 16*b* downstream of the secondary hole 46. As indicated above, the secondary hole 46 in the form of a dilution hole produces a jet of the compressor air 16 which has little, if any, capability of restarting the film layer 16*b*. The first row of transition holes 50, however, are relatively small and closely spaced together so that the cooling air 16 channeled air therethrough restarts the film layer 16*b*.

Since the multiholes 44 are inclined at about 20° through the liner wall 20*a*, the aft row of transition holes 50 immediately adjacent thereto are inclined at a greater inclination angle B of about 32.5° for example. The forward row of transition holes 50 therefore matches the perpendicular orientation of the secondary hole 46, whereas the aft row of transition holes 50 approaches the inclination angle of the multiholes 44 within the available space.

A third, or middle row of transition holes 50 may be disposed between the forward and aft rows and have an inclination angle B of about 45° through the liner wall 20*a*. The middle row of transition holes 50 therefore provides a transition or progression between the forward and aft rows of transition holes for maximizing the number of transition holes within the available space above the shadow 48 without adversely affecting liner strength.

One or more of the different rows of transition holes 50 illustrated in FIGS. 2 and 3 may be used in the shadow 48 as required for providing enhanced cooling downstream of the secondary holes 46. For relatively small secondary holes 46, correspondingly fewer transition holes 50 are required and may have any suitable inclination from perpendicular to just larger than the shallow inclination angle of the multiholes 44. In the FIG. 2 and 3 embodiment, all three types of transition holes having inclination angles of 32.5°, 45°, and 90° are used between the secondary hole 46 and the downstream multiholes 44 in the shadow 48.

In FIG. 4, the dilution hole 46 is shown with two rows only of transition holes 50 having only 45° inclination angles.

Also shown in FIG. 4 is the borescope hole 46*c* typically provided for inserting a conventional borescope through the liner for inspection of the combustor during a maintenance outage. In this embodiment, two rows of the transition holes 50 at solely the 45° inclination angle are used in a different pattern.

Figure 5:
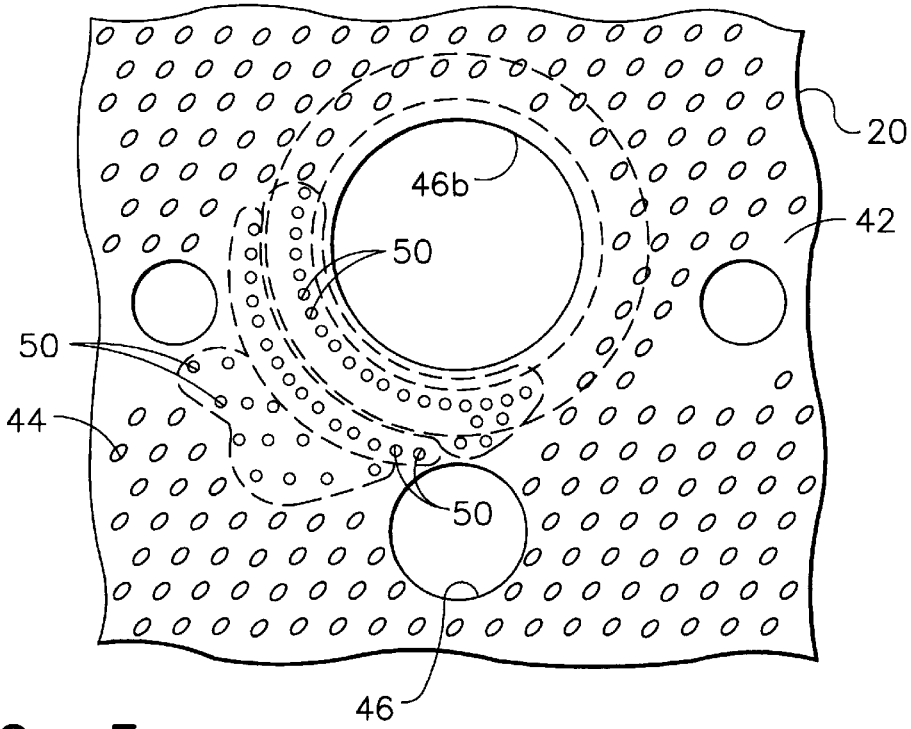
FIG. 5 is an outward facing view of a portion of the outer liner illustrated in FIG. 1 taken along line 5—5 in the region of an igniter port including transition holes in accordance with another embodiment of the present invention.

In FIG. 5, the igniter port 46*b* is illustrated through which the conventional igniter 30 shown in FIG. 1 is mounted for starting the combustion process. The igniter port 46*b* is a relatively large aperture, and therefore several rows with relatively high density of all three types of transition holes at 32.5°, 45°, and 90° are used between the downstream edge of the igniter port 46*b* and the multiholes 44 spaced downstream therefrom.

In the preferred embodiment illustrated in FIGS. 2 and 3, the transition holes 50 having an inclination angle B above 20° and below 90° are inclined coextensively in the same manner and direction as the corresponding multiholes 44. The inclination direction of the transition holes 50 and multiholes 40 match the predominant swirl direction of the combustion gases 32 along the direction of the corresponding shadow 48 extending from the secondary hole 46. In this way, the first or perpendicular row of transition holes 50 first injects the cooling air 16 to the inboard surface 42 for restarting the cooling film layer 16*b* and, the following two rows of transition holes 50 further feed and build the thickness of the film layer 16*b*, which is followed in turn by additional replenishment air from the succeeding rows of multiholes 44.

Figure 6:
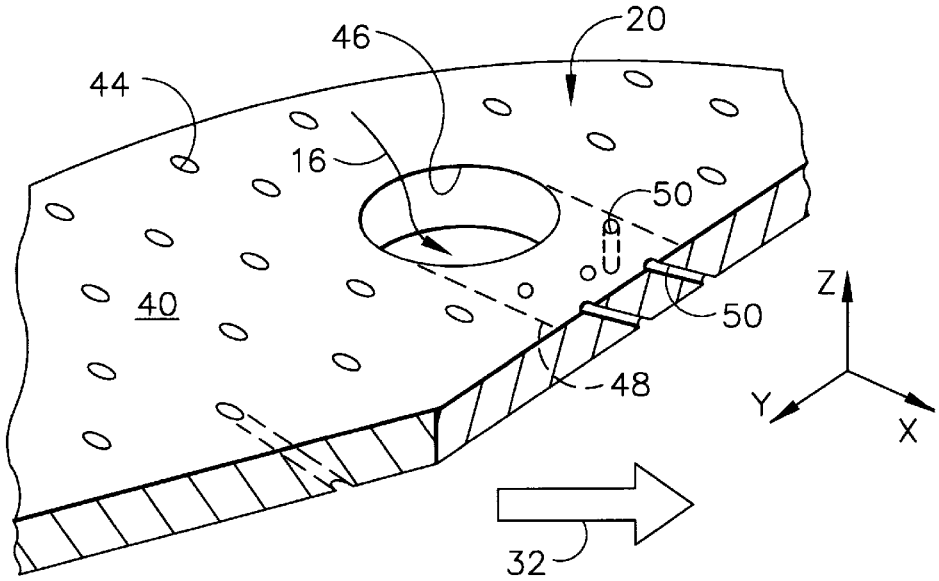
FIG. 6 is an isometric top view of another portion of the outer liner illustrated in FIG. 1 showing transition holes in the shadow of a dilution hole in accordance with another embodiment of the present invention.

However, in an alternate embodiment of the invention as illustrated in FIG. 6, some of the transition holes 50 may be inclined laterally or circumferentially askew in the shadow 48 in an orientation skewed from the orientation of the multiholes 44 and shadow 48. This may allow additional density in the pattern of transition holes 50.

Placing transition holes at 90° to the surface allows the cooling air 16 to be placed closely adjacent to the obstruction formed by the secondary holes 46 and provides effective cooling in the local area downstream therefrom. The gradual transition from 90° to 20° increases the tendency of the cooling air 16 to bend over and attach to the inboard surface 42 of the liner. Additional cooling benefit is obtained by the extended bore lengths of the transition holes 50 through the liner. The additional cooling effectiveness of the transition holes 50 decreases the local temperature at the shadow region which correspondingly increases life and adds to the durability of the combustion liner.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. A combustor liner comprising:

a wall having an outboard surface over which is flowable a cooling fluid, and a opposite inboard surface for facing combustion gases;

a plurality of first holes inclined through said wall at an acute inclination angle from said surfaces thereof in a multihole pattern to channel said cooling fluid therethrough to form a cooling film layer of said cooling fluid along said inboard surface;

a second hole extending perpendicularly through said wall within said multihole pattern to form a shadow along said inboard surface devoid of said first holes in which said film layer is locally interrupted; and a transition hole extending through said wall in said shadow at a greater inclination than said first holes for cooling said wall at said shadow, and having an outlet at said inboard surface spaced no closer to said second hole than an inlet thereof at said outboard surface.

2. A liner according to claim 1 wherein:

said second hole is larger in diameter than said first holes, and said shadow extends laterally thereacross; and said shadow includes a plurality of said transition holes spaced apart from each other to cool said wall at said shadow.

3. A liner according to claim 2 wherein:

said first holes have a length over diameter aspect ratio greater than 1.0;

said second hole has a length over diameter aspect ratio less than 1.0; and said transition holes have a length over diameter aspect ratio therebetween.

4. A liner according to claim 3 wherein said first holes and said transition holes have equal diameters.

5. A liner according to claim 3 wherein:

said first holes have an inclination angle through said wall of about 20°; and said transition holes are arranged in three rows having corresponding inclination angles through said wall of 32.5°, 45°, and 90° from said first holes toward said second hole in turn.

6. A liner according to claim 3 wherein said shadow extends downstream from said second hole and includes a plurality of rows of said transition holes spaced apart between said second hole and said first holes, and changing in inclination angle from row to row thereof, with an aft row of said transition holes having outlets spaced further from said second hole than corresponding inlets thereof.

7. A liner according to claim 6 wherein said transition holes progressively decrease in inclination downstream from said second hole from row to row thereof.

8. A liner according to claim 7 wherein said transition holes include a forward row adjacent said second hole extending perpendicularly through said wall.

9. A liner according to claim 8 wherein:

said first holes are inclined at about 20° through said wall; and said transition holes in said aft row adjacent said first holes are inclined at about 32.5° through said wall.

10. A liner according to claim 9 wherein said second hole is an igniter sort.

11. A liner according to claim 10 wherein said transition holes include a third row inclined at about 45° through said wall, and disposed between said two forward and aft rows at 90° and 32.5°.

12. A liner according to claim 3 wherein:

said second hole is a dilution hole;

and only two rows of said transition holes are disposed in said shadow and inclined at about 45° through said wall.

13. A liner according to claim 3 wherein:

said second hole is a borescope hole;

and only two rows of said transition holes are disposed in said shadow and inclined at about 45° through said wall.

14. A liner according to claim 3 wherein said transition holes are disposed solely in said shadow within the diameter of said second hole, and said first holes circumferentially adjoin said shadow.

15. A method of using said combustor liner according to claim 3 comprising:

surrounding said second hole with said first holes to a physical limit preventing additional ones of said first holes from being used during operation in said shadow which would create local stress concentrations adversely affecting liner strength; and spacing said transition holes from of said second hole to physically fit in said shadow for cooling said wall thereat while still maintaining adequate strength of said liner.

16. A method according to claim 15 further comprising inclining said transition holes through said wall to distribute outlets thereof between said second hole and said first holes for restarting said film layer locally interrupted by said second hole.

17. A combustor liner comprising:

a wall having an outboard surface over which is flowable a cooling fluid, and a opposite inboard surface for facing combustion gases flowable in a downstream direction therealong;

a plurality of first holes inclined through said wall at an acute downstream inclination angle from said surfaces thereof in a multihole pattern to channel said cooling fluid therethrough to form a cooling film layer of said cooling fluid along said inboard surface;

a second hole extending perpendicularly through said wall within said multihole pattern to form a shadow along said inboard surface devoid of said first holes in which said film layer is locally interrupted; and a plurality of rows of transition holes inclined downstream through said wall in said shadow, and having inlets on said outboard surface spaced closer to said second hole than corresponding outlets thereof on said inboard surface.

18. A liner according to claim 17 wherein:

said first holes have a length over diameter aspect ratio greater than 1.0;

said second hole is larger in diameter than said first holes, and has a length over diameter aspect ratio less than 1.0; and said transition holes have a length over diameter aspect ratio therebetween.

19. A liner according to claim 18 wherein said first holes and said transition holes have equal diameters.

20. A liner according to claim 19 wherein:

said first holes have an inclination angle through said wall of about 20°; and said transition holes are disposed in two rows between said second hole and said first holes having corresponding inclination angles of 45° and 32.5° for transitioning in turn to said 20° first holes.

* * * * *